US005404817A

United States Patent [19]

Cuff

[11] Patent Number: 5,404,817

[45] Date of Patent: Apr. 11, 1995

[54] PAPER PRE-LOADER FOR OFFSET PRESSES

[76] Inventor: Corby S. Cuff, 609 Queens Avenue, New Westminster, British Columbia, Canada, V3M 1L1

[21] Appl. No.: 107,591

[22] Filed: Aug. 18, 1993

[51] Int. Cl.[6] ..... B41F 13/24

[52] U.S. Cl. ..... 101/232; 101/DIG. 35; 414/789.1; 414/790.8; 414/795.8

[58] Field of Search ..... 101/476, 232, 236, 237, 101/238, 239, 240, 216, DIG. 35; 414/19, 788.9, 788.8, 789.7, 789.9, 789, 789.1, 790.6, 790.3, 790.7, 790.8, 792.7, 792.8, 794.7, 794.8, 795.4, 795.8, 796.2, 798.2, 798.8

[56] References Cited

U.S. PATENT DOCUMENTS

| | | | |
|---|---|---|---|
| 2,937,485 | 5/1960 | Wall | 414/789.1 |
| 3,876,087 | 4/1975 | Osta | 101/216 |
| 3,908,836 | 9/1975 | Ikeda | 414/789.1 |
| 4,192,496 | 3/1980 | Baselice et al. | 414/795.8 |
| 4,222,697 | 9/1980 | Vits | 414/790.8 |
| 4,613,268 | 9/1986 | Capdebuscq et al. | 414/795.4 |
| 4,765,790 | 8/1988 | Besemann | 414/790.8 |
| 4,777,876 | 10/1988 | Ishii | 101/240 |
| 4,960,049 | 10/1990 | Mimura et al. | 701/232 |
| 5,061,233 | 10/1991 | Schultz et al. | 414/798.2 |
| 5,096,372 | 3/1992 | Maejima | 414/795.8 |

FOREIGN PATENT DOCUMENTS

| | | | |
|---|---|---|---|
| 0473910 | 3/1992 | European Pat. Off. | 414/788.8 |
| 1081476 | 5/1960 | Germany | 101/216 |
| 3136950 | 10/1982 | Germany | 414/790.8 |

*Primary Examiner*—Eugene H. Eickholt

*Attorney, Agent, or Firm*—Oyen Wiggs Green & Mutala

[57] ABSTRACT

This invention pertains to a novel wagon which holds a stack of printing paper. More particularly, this invention relates to a paper stack holding truck (pre-loader) which assists in efficiently loading paper into a offset printing press, and thereby reduces press down time. A paper pre-loader for an offset printing press compressing: (a) a wagon frame; (b) at least three wheels rotatably mounted to the underside of the wagon frame; (c) a pair of adjustable width paper guides extending vertically upwardly from the wagon frame; and (d) a paper board for enabling a stack of paper to be readily moved from the top of the wagon frame onto a paper deck of an offset printing press.

14 Claims, 4 Drawing Sheets

FIG. 1
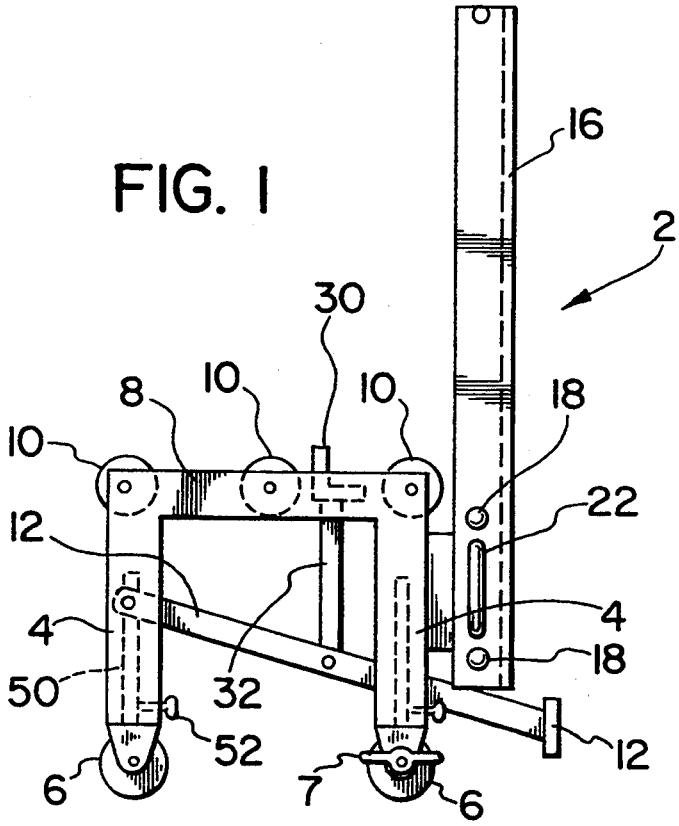
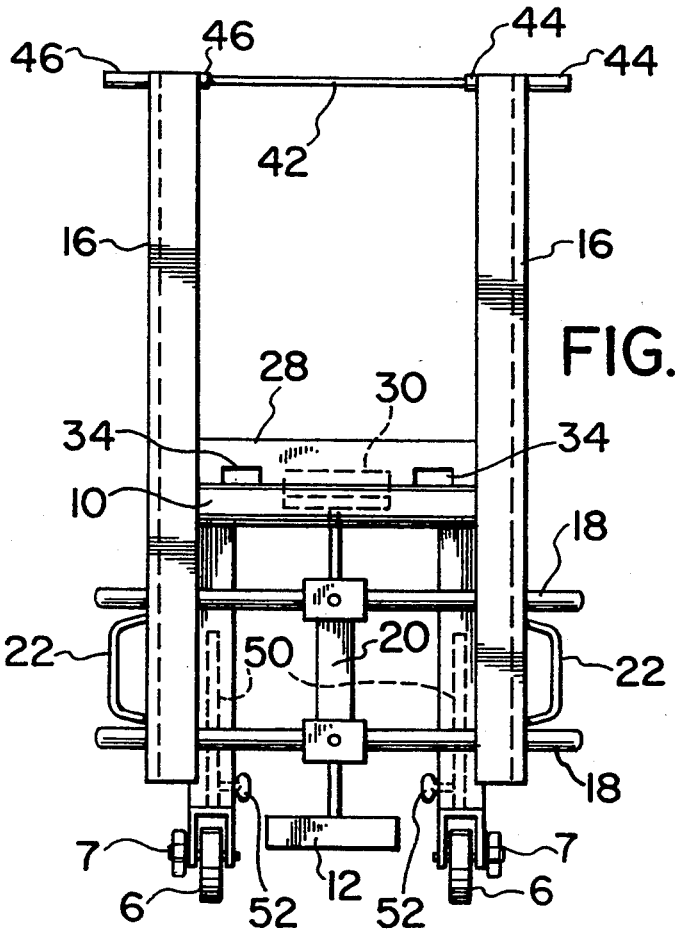
FIG. 2

PAPER PRE-LOADER FOR OFFSET PRESSES

FIELD OF THE INVENTION

This invention pertains to a novel moveable cart which holds a stack of printing paper. More particularly, this invention relates to a novel paper stack holding pre-loader which assists in efficiently loading paper into a offset printing press, and thereby reduces press down-time.

BACKGROUND OF THE INVENTION

Small offset printing presses available on the marketplace under the names A. B. Dick, Multi graph and Hamada hold about 4000 sheets of paper at a time. This is a serious restriction if large runs of paper, for example, 20,000 sheets, or more are to be printed. The printing press must be turned off while being loaded with paper, which results in printing press down-time. Approximately ten minutes is required to load approximately 4,000 sheets of paper into a press. Thus, if about 20,000 sheets of paper must be printed, the press will be idle for a total of forty minutes while it is being loaded with approximately 4,000 sheet batches during four stages. There is a need for an apparatus which can reduce the press down-time.

SUMMARY OF THE INVENTION

In one embodiment, the invention is directed to a paper pre-loader for an offset printing press comprising: (a) a wagon frame; (b) at least three wheels and preferably four wheels means rotatably mounted to the underside of the wagon frame two of which wheel means can be fixed; (c) a pair of adjustable width paper guides extending vertically upwardly from the wagon frame; and (d) moveable roller means on the top of the wagon frame for enabling a stack of paper to be readily moved from the top of the wagon frame onto a paper deck of an offset printing press.

In the paper pre-loader as described, the elevation of the wagon can be adjustable on all three or more wheels to adjust the elevation of the pre-loader to the elevation of the paper deck of a printing press to ensure smooth loading to each individual offset press.

Three rotatable rollers extend laterally between the sides of the frame which allows smooth transfer of the paper stack from the wagon deck onto the deck of the offset press.

In the pre-loader, the stack of paper can be mounted on a paper board which can be rolled from the rollers on the top of the wagon frame onto the paper deck of the offset printing press. In the pre-loader, a moveable brake holds the paper board in position on the rollers. The paper board can have longitudinal grooves in the under side thereof.

A pre-loader as described wherein a pair of adjustable width parallel longitudinally extending board supports are mounted on the paper deck of the offset press, the supports being slidably engageable with the grooves in the underside of the board. The pair of grooves can each be flared at the front end of the board. The underside of the paper board can have a recess therein which receives the brake.

In the pre-loader, the pair of adjustable vertical width paper guides can be slidably mounted on a pair of horizontal bars mounted on the rear of the wagon frame. The tops of the pair of paper guides can be held in place with an adjustable length cross-bar.

BRIEF DESCRIPTION OF THE DRAWINGS

In drawings which are intended to illustrate specific embodiments of the invention, but which are not intended to restrict the spirit or scope of the invention in any way:

FIG. 1 illustrates a side elevational view of the paper pre-loader;

FIG. 2 illustrates a rear elevational view of the paper pre-loader;

DETAILED DESCRIPTION OF SPECIFIC EMBODIMENTS OF THE INVENTION

Paper Installation Procedure

Figure 8:
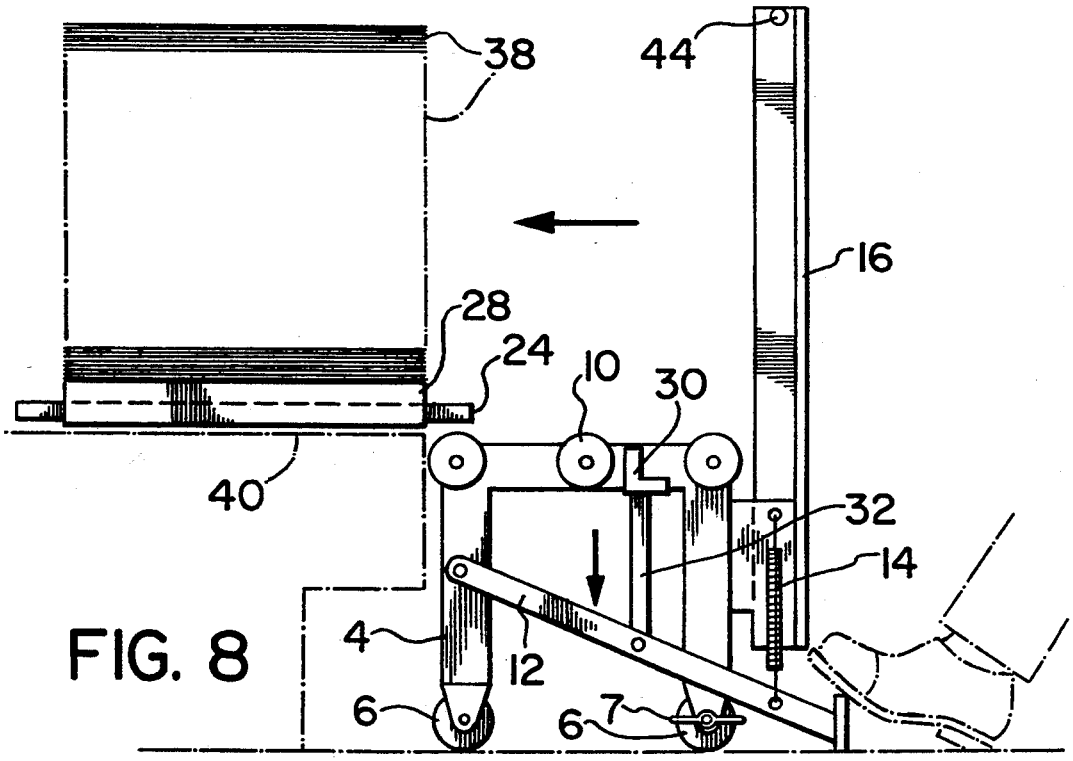
FIG. 8 illustrates a side partial section view of the pre-loader after the board loaded with paper has been shifted onto the paper loading deck of an offset printing press.

The pre-loader according to the invention enables a person to pre-load approximately 4,000 sheets of paper onto a grooved paper board, which is positioned on the top of a wheeled truck. When the paper supply has been consumed by an offset press, the wheeled pre-loader which has been loaded with a stack of approximately 4,000 further sheets is wheeled up to the paper deck, of the offset press, the grooves of the paper board are aligned with the board supports on the paper deck, the paper board is released from the pre-loader by depressing a foot brake and the paper board with the 4,000 sheets is easily rolled off the pre-loader into the paper deck of the press (see FIG. 8). The pre-loader allows the user to pre-load paper while the press is running. As soon as the offset press is out of paper, the user simply rolls the stack of paper on the board on the pre-loader onto the press deck and resumes printing. Thus saves valuable time.

The vertical paper guide of the pre-loader and the board supports of the offset press must be adjusted to fit the width of paper that is to be printed. Pre-loader adjustment is done by adjusting the width of the paper guides to match the width of the paper. The tops of the two vertical paper guides are stabilized by a cross-bar which has manually moveable nuts which connect the cross-bar ends with the tops of the two guides.

Once the width of the paper guides is set, and the nuts of the cross-bar on the tops of the two guides have been set, the paper-board is placed into position on the pre-loader. The top of the activatable foot brake extends into a corresponding groove in the under side of the paper board to hold it securely in place. The wheels of the pre-loader are braked. Four thousand sheets of paper are then neatly stacked on the paper board (see FIG. 7). Once the pre-loader is loaded, and the offset press requires paper, the pre-loader with its paper stack is wheeled to the paper deck of the offset press. The operator then steps on the foot brake to release the top of the brake from the underside groove in the board and paper stack. The paper stack and board are then pushed from the rollers on the top of the pre-loader into the press paper deck (see FIG. 8). Now that the paper stack is installed in the paper deck of the press, printing can resume.

Three standard paper sizes are used with standard offset printing presses. For each size of paper, two plywood paper boards are cut to the exact size of the paper. Two boards of the same size are required so that while one board is on the paper deck of the printing press, the other is on the top of the pre-loader available for stacking of paper.

The adjustable paper guides slide laterally along horizontal bars, thereby allowing the width between the two guides to correspond with the width of any of the common widths of printing paper. They are moved by pushing or pulling on the handles. The paper guides must be adjusted so that the inside distance between the paper guides is equal to the width of the paper to be fed to the printing press.

Once the paper guides are set to a desired width, the rear end of the paper board is placed between them. The width of the board supports or the paper deck of the offset press are then adjusted so that they fit in a pair of flared grooves on the underside of the paper board on the pre-loader.

Apparatus

Referring to FIG. 1 which illustrates a side elevational view of the paper pre-loader 2, it is constructed in a box-like configuration with four vertical legs at the four corners. These legs 4 have at least two caster wheels 6 at the base of two of the legs 4 (preferably the front two legs the direction of the other two wheels, preferably the rear wheels can be fixed) a pair of side rails 8 at the respective top lateral sides of the two pairs of legs 4, with three lateral horizontal rollers 10 rotationally mounted on the side rails 8 and spaced parallel from one another from the front to the back of the top of the pre-loader 2. Extending longitudinally between the two pairs of vertical legs 4, below the three lateral rollers 10, is a foot lever 12 which is held in a generally horizontal position by a tension coil spring 14 (not visible, but see FIG. 8). A pair of adjustable width vertical paper guides 16 is positioned at the rear two corners of the pre-loader 2. The foot lever 12 is pivotally connected by link 32 to a board brake 30, which, when raised, fits into a groove 36 formed in the underside of a paper board 28, as will be explained below. FIG. 1 also illustrates that the wheels 6 may be mounted on stems 50 which penetrate upwardly inside each leg 4 and can be secured in place by thumbscrews 52, to thereby enable the wheels 6 to be extended and thereby adjust the elevation of the rollers 10 of the pre-loader 2. In this way the elevation of the top of the pre-loader can be adjusted to accommodate different elevations of paper decks on different printing presses.

Referring to FIG. 2, which illustrates a rear elevational view of the pre-loader 2, it can be seen that the two vertical paper guides 16 are slidably mounted on a pair of horizontal laterally extending rods 18 which are positioned one above the other and parallel with one another. The two horizontal rods 18 are held securely together by a holding plate 20 on the pre-loader 2. The two vertical paper guides 16, which are constructed of angle iron, can be manually slid laterally together or away from one another along the rods 18, to accommodate different widths of paper stacks, by gripping the handles 22 and pulling or pushing appropriately. A paper loading board 28 is shown in end view positioned on the rollers 10. The rear end of the paper board 28 fits between the base of the two paper guides 16.

FIG. 2 also illustrates a cross-bar 42 which provides rigidity to the top ends of the two vertical paper guides 16. The cross-bar 42 is secured in position at any width between the paper guides by rotationally moving the first and second pairs of adjustable nuts 44 and 46 as required. The cross-bar 2 also can act as a handle to assist rolling the pre-loader 2.

Figure 3:
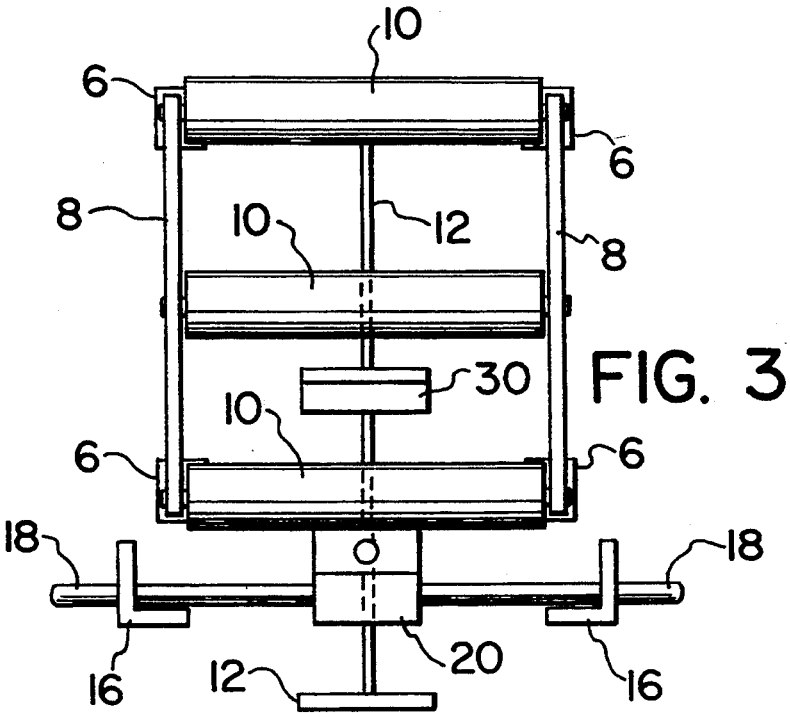
FIG. 3 illustrates a top view of the paper pre-loader.

Referring to FIG. 3, which illustrates a top view of the pre-loader 2, it can be seen that the three laterally extending parallel rollers 10, are rotationally mounted at the front, middle and rear of the pre-loader between the two side rails 8. The top end of the board brake 30, which fits in the groove 36 of the paper board 28 (not shown) can also be seen.

Figure 4:
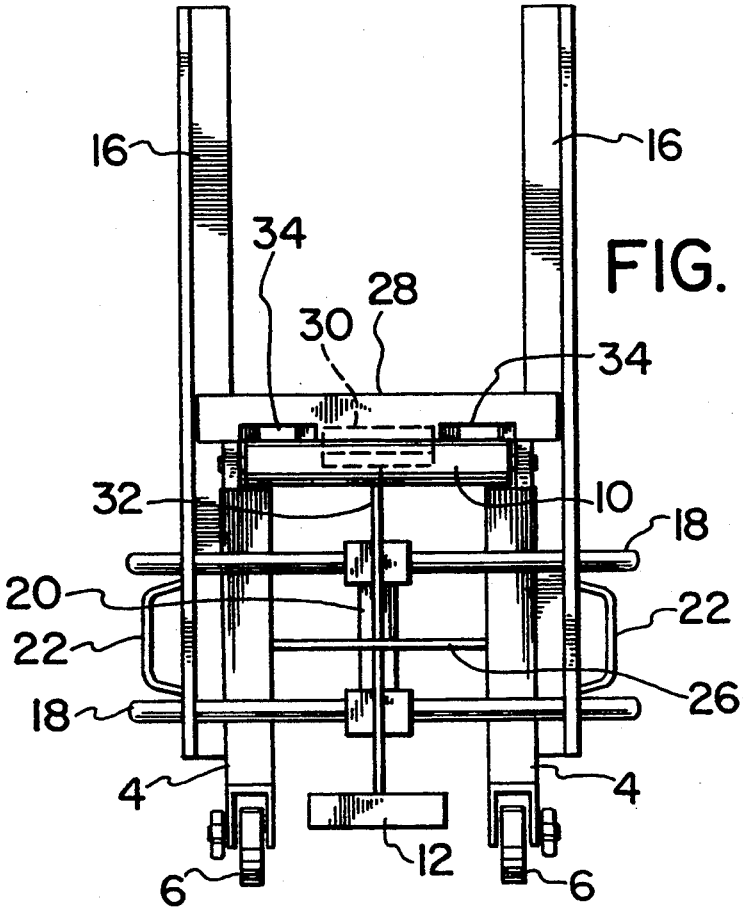
FIG. 4 illustrates a front elevational view of the paper pre-loader.

Referring to FIG. 4, which illustrates a front elevational view of the pre-loader 2, the foot lever 12 is hingedly mounted on a reinforcing bar 26 extending between the two front legs 4. This hinged action permits the foot lever 12 to move upwardly and downwardly. This action moves the board brake 30 upwardly or downwardly via link 32. The paper loading board 28 rests on the three rollers 10.

Figure 5:
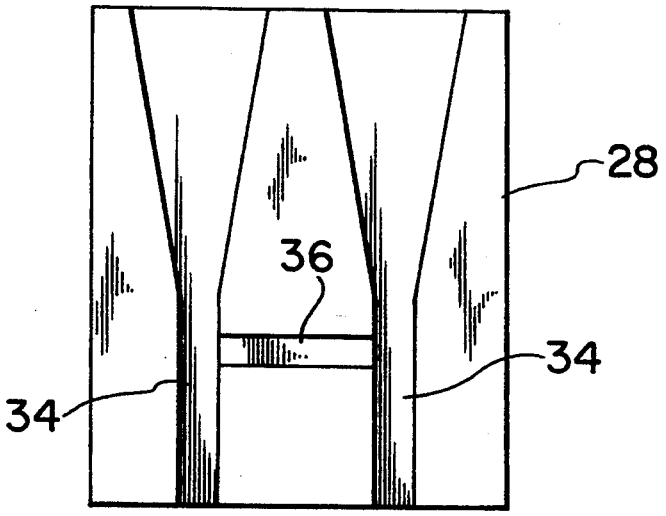
FIG. 5 illustrates a bottom view of the paper loading board.

FIG. 5 illustrates a bottom view of the paper loading board 28. There are two respective paper boards 28 for each particular width of paper. The longitudinal grooves 34 in the underside of each board vary in length (refer to FIG. 6). A parallel pair of longitudinally extending board support receiving grooves 34 are formed in the underside of the paper board 28. It will be noted that the pair of parallel board support grooves 34 are flared at the front end (the printing press end) of the board 28. These flares assist the pair of grooves 34 in aligning on the parallel pair of board supports 24 (see FIGS. 7 and 8), which fit in a lateral slot on the paper deck 40 of an offset press. The distance (with) between the pair of board supports 24 can be adjusted by sliding them as required in the slot on the paper deck 40. Extending laterally between the two longitudinal grooves 34 on the underside of the paper board 28 is a brake groove 36 which is adapted to receive the board brake 30 of the foot lever 12 (see FIG. 1), when the board brake 30 is in its upper position. The board brake 30 prevents the paper board 28, and the stacked paper load on the paper board 28 from sliding off the rollers 10 of the pre-loader 2, unless the foot lever 12 is deliberately depressed.

Figure 6:
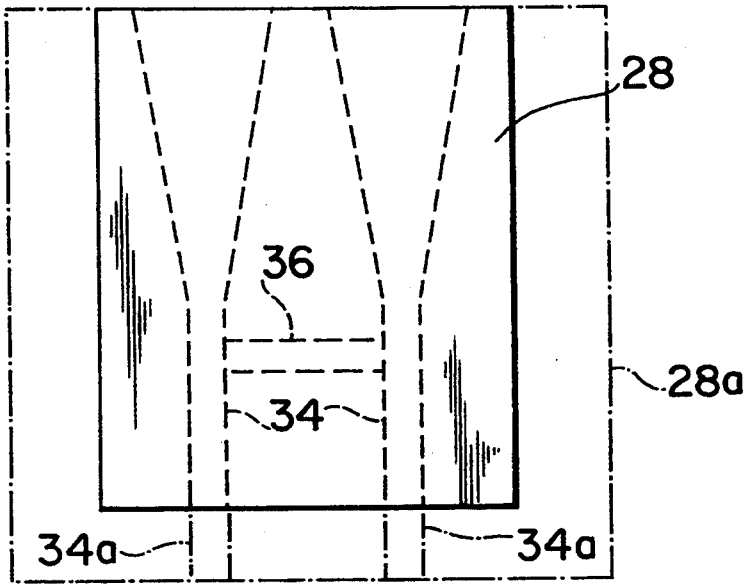
FIG. 6 illustrates a top view of the paper loading board.

FIG. 6 illustrates a top view of the paper loading board 28, and in dotted lines a larger size board 28*a*. The rear end of the paper board 28 fits between the two vertical paper guides 16. The two grooves 34, shown in dotted lines are flared at the front end. The distance between the grooves 34 remain the same but the grooves are longer for the larger board 28*a*.

Figure 7:
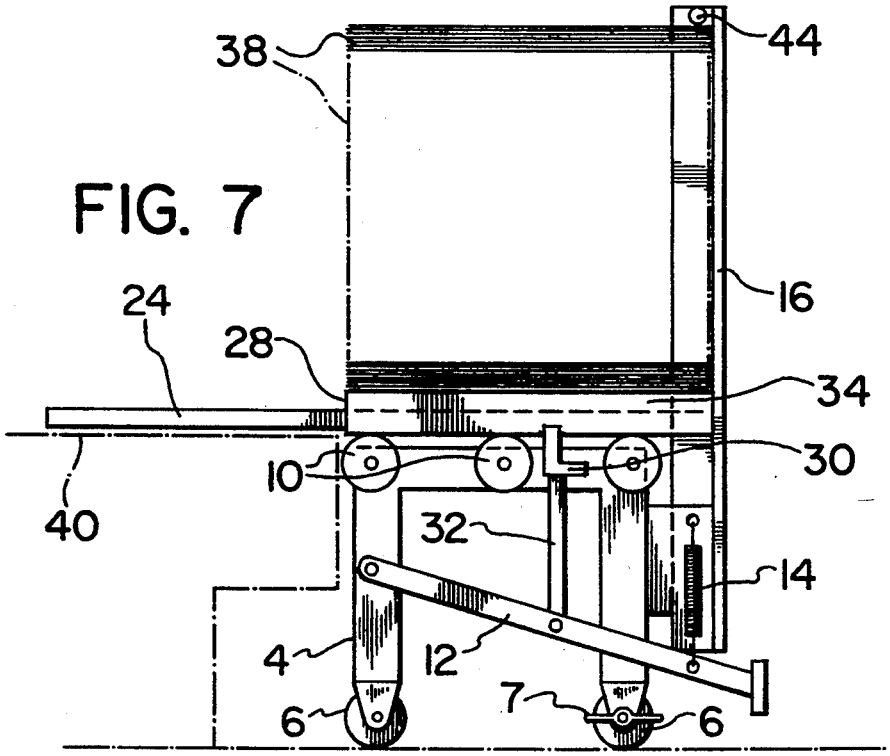
FIG. 7 illustrates a side partial section view of the pre-loader loaded with paper.

FIG. 7 illustrates a side partial section view of the pre-loader 2, with a full stack of paper 38 loaded onto the top of the paper board 28. The rear edges of the paper stack 38 and the paper board 28 abut and fit between the vertical paper guides 16. One or more wheel brakes 7 which are mounted with wheels 6 can be operated manually or by foot. These brakes 7 are used to hold the pre-loader in stationary position when the paper board 28 is placed in position on the rollers 10 of the pre-loader 2, and the paper 38 is stacked on the paper board 28. FIG. 7 also shows the pair of board supports 24 which are on the paper deck 40 of the press and are not part of the pre-loader 2. The pair of board supports 24 are positioned on the paper deck 40 of the press so that they are received by the grooves 34 on the underside of the paper board 28 when the paper board 28 is slid onto the deck 40. The wheel brakes 7 are released when the paper stack 38 is in place and the operator wants to wheel the loaded pre-loader into position against the paper deck 40 of the offset press.

To enable the stack of paper 38 and the paper board 28 to be moved off the rollers 10 onto the paper receiving deck 40 of the printing press, the operator depresses the foot lever 12 (see FIG. 8) to thereby lower the brake 30 from within the brake groove 36 on the underside of the paper board 28. The paper board 28 and its paper stack 38 can then be readily rolled off the three rollers 10 and onto the board supports 24 of the paper deck 40 of the offset printing press as shown by arrows in FIG. 8. The coil spring 14 returns to its compressed upright position when the foot is removed from foot lever 12. After the paper stack 38 is exhausted by the press, the empty board 38 can be slid off the two board supports 24 back on to the pre-loader 2. The two board supports 24 on the paper deck 40 are then received in the grooves 34 of the second board 28 when it has been placed on the pre-loader with another stack 38 loaded onto the pre-loader 2. The process is then repeated.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A paper pre-loader for use with the paper deck of an offset printing press comprising:

(a) a wagon frame wherein the top of the wagon frame has two sides;

(b) at least three wheels rotatably mounted to the underside of the wagon frame;

(c) a pair of adjustable width paper guides extending vertically upwardly from the wagon frame; and (d) means comprising at least two rotatable rollers extending laterally between the two sides of the wagon frame for enabling a stack of paper to be placed on the wagon frame and readily moved from the top of the wagon frame onto a paper deck of an offset printing press.

2. A pre-loader as claimed in claim 1 wherein three rotatable rollers extend laterally between the two sides of the wagon frame.

3. A pre-loader as claimed in claim 2 including a paper board and the stack of paper is mounted on the paper board which is adapted to be rolled from the top of the rollers onto the paper deck of the offset printing press.

4. A pre-loader as claimed in claim 3 wherein a releasable brake holds the paper board in position on the rollers.

5. A pre-loader as claimed in claim 3 wherein the paper board has longitudinal grooves in the under side thereof, which grooves are adapted to be received by corresponding board supports mounted on the paper deck of the printing press.

6. A pre-loader as claimed in claim 5 wherein there are a pair of grooves which are each flared at an end of the paper board which faces the paper deck of the printing press.

7. A pre-loader as claimed in claim 4 wherein the underside of the paper board has a recess therein which receives the releasable brake.

8. A pre-loader as claimed in claim 1 wherein the pair of adjustable vertical width paper guides is slidably mounted on a pair of horizontal bars mounted on the rear of the wagon frame.

9. A pre-loader as claimed in claim 8 including a cross-bar which can be releasably secured to the top ends of the two paper guides.

10. A pre-loader as claimed in claim 1 wherein the wheels comprise a pair of stationary wheels and a swivel wheel.

11. A pre-loader as claimed in claim 10 including a releasable brake on at least one of the wheels.

12. A pre-loader as claimed in claim 1 including means for adjusting the height of the pre-loader.

13. A pre-loader as claimed in claim 1 wherein the pre-loader has four wheels including a pair of stationary wheels and a pair of swivel wheels.

14. A pre-loader as claimed in claim 13 including means for adjusting the elevation of the wheels relative to the wagon frame to adjust the height of the pre-loader.

* * * * *